US007104015B2

(12) United States Patent
Huynh

(10) Patent No.: US 7,104,015 B2
(45) Date of Patent: Sep. 12, 2006

(54) WINDOW ASSEMBLY FOR BUILDINGS IN SEISMIC ZONES

(76) Inventor: Thoi Huu Huynh, 6565 23rd Ave. SW., Seattle, WA (US) 98106

( * ) Notice: Subject to any disclaimer, the term of this patent is extended or adjusted under 35 U.S.C. 154(b) by 440 days.

(21) Appl. No.: 10/331,045

(22) Filed: Dec. 28, 2002

(65) Prior Publication Data

US 2003/0159376 A1 Aug. 28, 2003

Related U.S. Application Data

(60) Provisional application No. 60/359,219, filed on Feb. 22, 2002.

(51) Int. Cl.
*E06B 3/00* (2006.01)

(52) U.S. Cl. ..... 52/208; 52/204.62; 52/204.72; 52/770; 49/63

(58) Field of Classification Search ..... 52/208, 52/235, 167.1, 202, 203, 204.5, 204.591, 52/204.597, 204.6, 204.62, 204.72, 463, 52/770; 49/61, 62, 63, 501, 375
See application file for complete search history.

(56) References Cited

U.S. PATENT DOCUMENTS 2,221,005 A * 11/1940 Reese ..... 52/202
4,092,812 A * 6/1978 Dashner et al. ..... 52/309.3
4,215,517 A * 8/1980 Everson ..... 52/202
4,364,209 A * 12/1982 Gebhard ..... 52/208
4,452,020 A * 6/1984 Werner ..... 52/202
4,478,003 A * 10/1984 Flett ..... 49/63
4,494,342 A * 1/1985 Decker ..... 52/203
4,746,861 A * 5/1988 Nesbitt ..... 324/761
4,823,511 A * 4/1989 Herliczek et al. ..... 49/404
5,050,348 A * 9/1991 Kane et al. ..... 49/351
5,242,207 A * 9/1993 Carson et al. ..... 296/146.15
5,396,746 A * 3/1995 Whitmer ..... 52/208
5,560,671 A * 10/1996 Ojanen et al. ..... 296/146.14
5,735,089 A * 4/1998 Smith et al. ..... 52/202
5,806,256 A * 9/1998 Byrne ..... 52/204.5
5,809,707 A * 9/1998 Bargados et al. ..... 52/204.62
5,848,496 A * 12/1998 Bertolini et al. ..... 49/352
5,907,927 A * 6/1999 Lieb et al. ..... 49/375
6,408,574 B1 * 6/2002 Farrar et al. ..... 49/375
6,585,311 B1 * 7/2003 Farrar et al. ..... 296/146.5
6,588,152 B1 * 7/2003 Cabbane ..... 49/375

* cited by examiner

*Primary Examiner*—Yvonne M. Horton
(74) *Attorney, Agent, or Firm*—Dean A. Craine

(57) ABSTRACT

A window assembly (10) with its glazing frame that stays independently from lateral movement of building main structure (44) is disclosed. The window assembly (10) includes an outer retaining frame (12) and an inner glazing frame (14). The outer retaining frame (12) is attached to the building main structure(44). The glazing frame holds glass pane (20), and sits inside the outer retaining frame (12). Between the outer retaining frame (12) and the inner glazing frame (12) is a predetermined clearance space (X) and (Y), at their vertical edges and their top edge. The resulting window assembly allows the glazing frame to retain its shape, while the outer retaining frame (12) moves laterally with the main structure (44) during an earthquake or blast, thereby minimizing the chance of glass breakage. Application of glazing gasket (32) or sealant (54) provides water-tight result to the window assembly (10).

9 Claims, 7 Drawing Sheets

WINDOW ASSEMBLY FOR BUILDINGS IN SEISMIC ZONES

CROSS-REFERENCE TO RELATED APPLICATIONS

Provisional Patent Application No. 60/359,219
Filling date: Feb. 22, 2002.
Applicant: Thio H. Huynh
Title: Window Assembly For Buildings In Seismic Zones

STATEMENT REGARDING FEDRALLY SPONSORED RESEARCH OR DEVELOPMENT

Not applicable.

REFERENCE TO MICROFICHE APPENDIX

Not Applicable.

BACKGROUND OF THE INVENTION

1. Field of the Invention

This invention relates to window assemblies, and more specifically to window assemblies that are used in buildings located in seismic zones or in buildings designed to withstand a blast.

2. Description of the Related Art

Window assemblies in buildings are commonly installed by fastening, bolting or welding the window frame to the building's main structure.

Seismic movement creates story drift in buildings, which is the lateral displacement of one level relative to the level below or above. This causes lateral movement to the building main structure and the attached window frame.

The lateral movement of the window frame causes it to crush the glass panes in the window. Without adequate clearance space for the movement, the glass in window might break during a strong earthquake. The chance for glass breakage is greater in larger and taller glass panes, because they are affected by greater lateral displacement. However, large glass panes are highly desirable in many facilities including air traffic control tower cabs.

BRIEF SUMMARY OF THE INVENTION

The present invention is for a window assembly that has predetermined clearance spaces within the assembly, to allow for lateral displacement of the window frame, in order to minimize the chance of glass breakage. The window assembly includes an outer retaining frame and an inner glazing frame. The retaining frame is attached to building main structure by any of the common methods, and is expected to move laterally with the building main structure during earthquakes. The glazing frame holds glass pane and sits inside the retaining frame. Between the two frames are the predetermined clearance spaces to allow the glazing frame to stay in its shape, while the retaining frame moves as described, without crushing the glass.

BRIEF DESCRIPTION OF THE SEVERAL VIEWS OF THE DRAWING

In the drawings, closely related figures have the same number but different alphabetic suffixes.

FIG. 1A' shows an enlarged front elevational view of the lower right corner of the window assembly, which is illustrated in FIG. 1A.

REFERENCE NUMERALS IN DRAWINGS

Figure 1A:
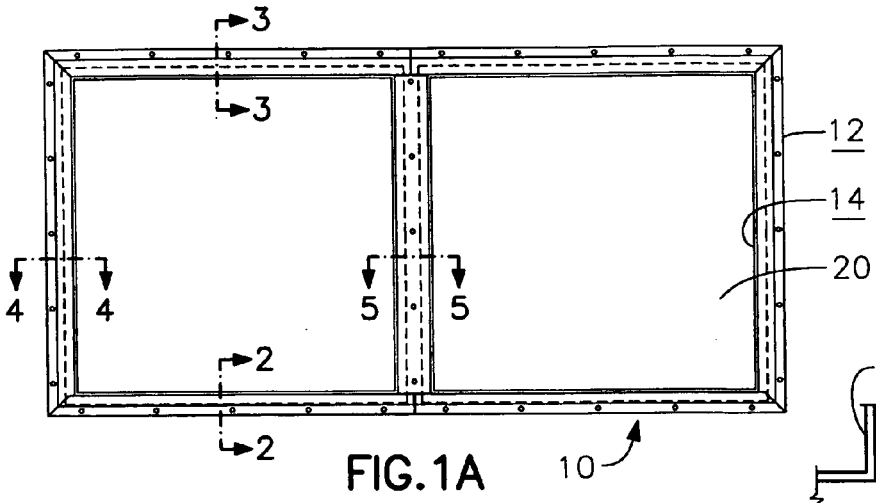
FIG. 1A shows a front elevational view of a window assembly made in accordance with a preferred embodiment of the present invention.
Figure 1A:
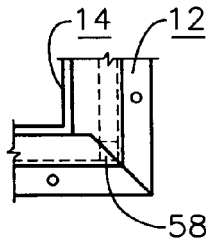

10 window assembly
12 retaining frame
14 glazing frame
20 glass pane
22 glazing channel
24 screw race
26 setting block
28 glazing tape
30 dart spacer
32 silicone sealant
33 sill retaining bracket fixed half
34 sill retaining bracket
35 sill retaining bracket removable half
36 header retaining bracket
37 header retaining bracket fixed half
38 fastener
39 header retaining bracket removable half
40 jamb retaining bracket
41 jamb retaining bracket fixed half
42 fastener
43 jamb retaining bracket removable half
44 building main structure
46 mullion retaining plate
47 mullion retaining tee bar
48 fastener
50 sealant spacer
52 shim
54 sealant
56 gasket
58 end block

DETAILED DESCRIPTION OF THE INVENTION

Referring to FIG. 1A, illustrated is an elevational view of a window assembly 10 made in accordance with a preferred embodiment of the present invention. A retaining frame 12 is made of a metal or another suitable material. A glazing frame 14 is also made of a metal or another suitable material. A glass pane 20 is made of sheet glass or other suitable materials.

Figure 2A:
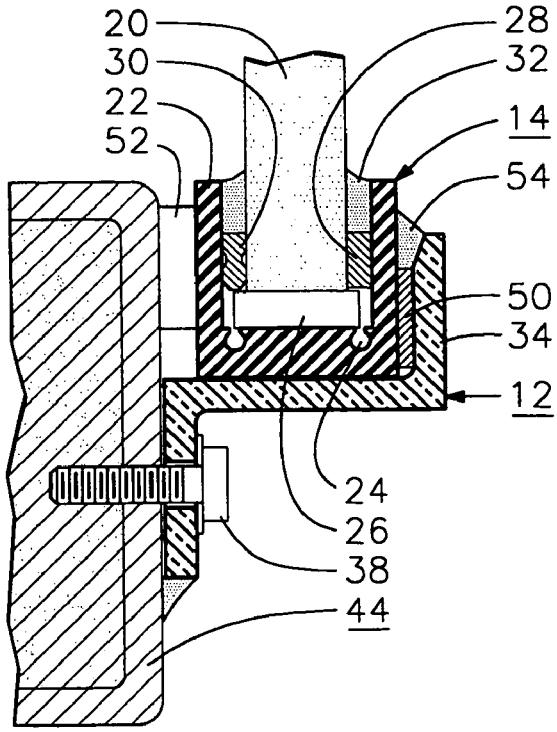
FIG. 2A shows a cross sectional view of the window assembly, taking along line 2—2 in FIG. 1A.

Referring to FIG. 2A, illustrated is a cross-sectional view of the windowsill. The glass pane 20 is glazed in a glazing channel 22 by one of the common glazing methods of the trade. A pair of setting blocks 26 are placed in between the glass bottom edge and glazing channel 22. Compatible glazing tape 28 and dart spacer 30 are placed in between the glass pane 20 and the glazing channel 22, providing space for silicone sealant 32 on both sides of the glass pane 20. The glazing channel 22 runs continuously around the perimeter of glass pane 20, and has mitered joints at the corners. The mentioned components form an inner frame 14, which is placed inside an outer retaining frame 12. At windowsill, retaining bracket 34 is part of an outer retaining frame 12. Retaining bracket 34 runs continuously, and is fastened or welded to building main structure 44.

Figure 3A:
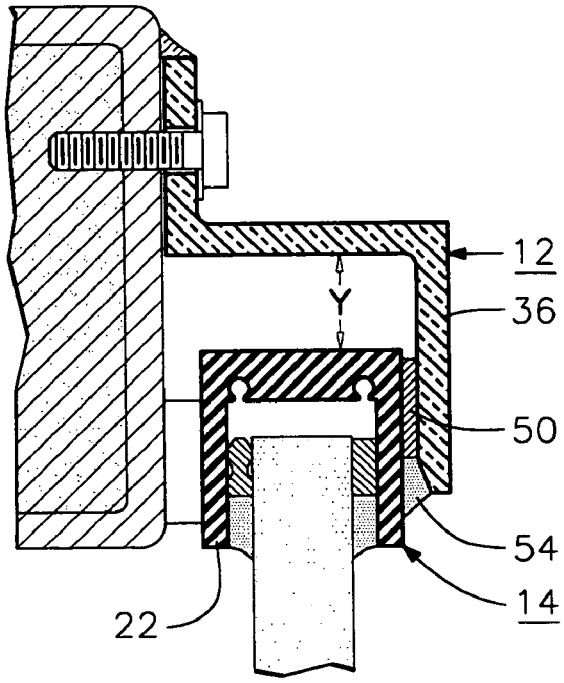
FIG. 3A shows a cross sectional view of the window assembly, taking along line 3—3 in FIG. 1A.

Referring to FIG. 3A, illustrated is a cross-sectional view of the window head. The outer retainer frame 12 is Z-shaped in cross-section with an outside leg, an intermediate leg, and an inside leg. Located inside the outer frame 12 is a U-shaped inner glazing frame 14. Between the outer retaining frame 12 and the inner glazing frame 14 is a predetermined clearance space Y. A sealant spacer 50 is place between the glazing channel 22 and the header retaining bracket 36. The sealant 54 runs continuously on the exterior edges to seal the gap between the outer retaining frame 12 and the inner glazing frame 14.

Figure 4A:
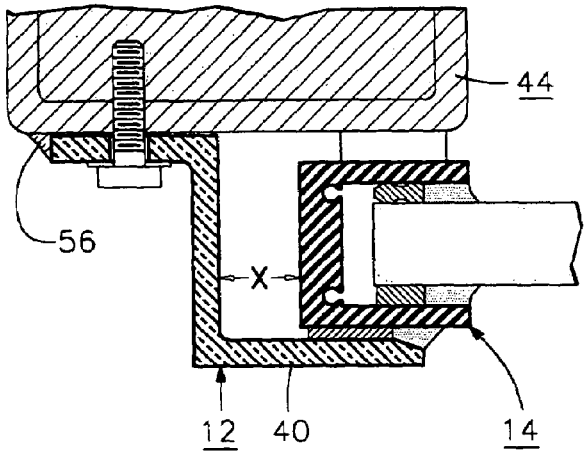
FIG. 4A shows a cross sectional view of the window assembly, taking along line 4—4 in FIG. 1A.

Referring to FIG. 4A, illustrated is a cross-sectional view of the window jamb. Between the outer retaining frame 12 and the inner glazing frame 14 is a predetermined clearance space X. The sealant 56 runs continuously on four sides to water seal between the outer retaining frame 12 and the building main structure 44.

Figure 5A:
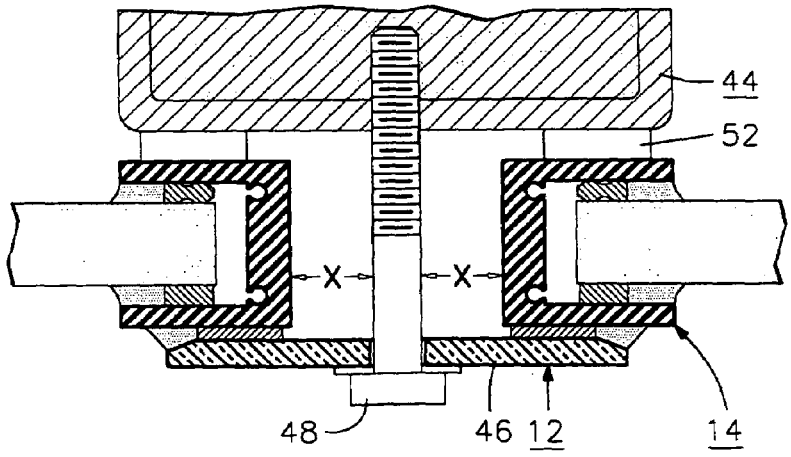
FIG. 5A shows a cross sectional view of the window assembly, taking along line 5—5 in FIG. 1A.

Referring to FIG. 5A, illustrated is a cross-sectional view of the window mid-mullion. Between the retaining plate 46 and the inner glazing frame 14 is a predetermined clearance space X. A retaining plate 46, which is part of the outer retaining frame 12, is fastened to the building main structure 44 by fastener 48. Between the main building structure 44 and the inner glazing frame 14 is shim 52, which is made of neoprene or another suitable material.

Operation

Seismic movement creates story drift, which is the lateral displacement of one level relative to level below or above, in an affected building. This causes lateral movement to the building main structure 44, which moves the outer retaining frame 12 in the same manner since the two are attached. When this occurs, the sealant 54 is expected to shear off, allowing the inner glazing frame 14 to retain its shape, while the outer retaining frame 12 moves laterally with building main structure 44, thereby minimizing the chance of glass breakage. A sealant 54 is replaceable and kept at minimal for its water sealing function only, not for structural bonding purpose. Clearance space X and clearance space Y are predetermined to sufficiently withstand the computed lateral movement, which is caused by an earthquake or a blast.

Additional Embodiments

Referring to FIG. 1A', an end block 58 is placed between the glazing frame 14 and the retaining frame 12 at each lower corner. These additional embodiment keep the glazing frame 14 at the same position in relation to the retaining frame 12, during and after an earthquake.

Figure 2B:
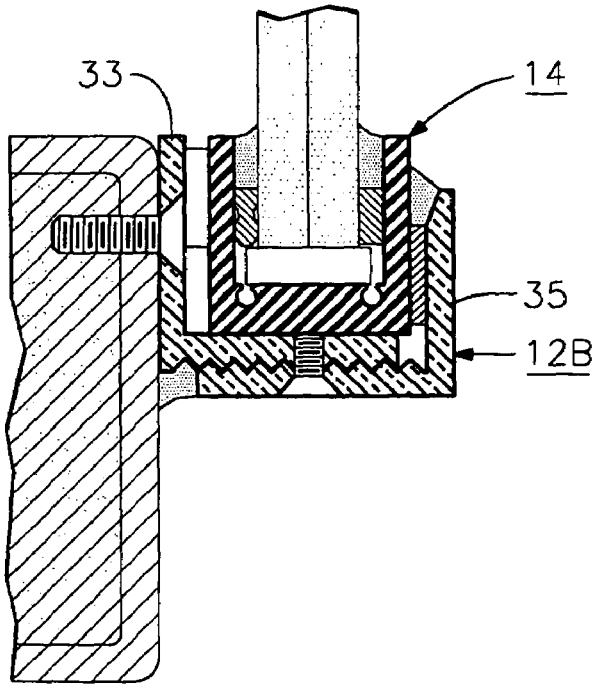
Figure 2C:
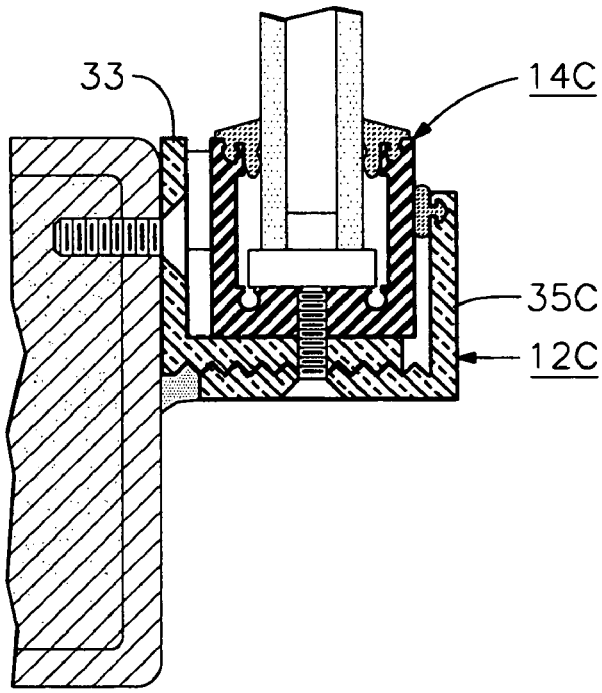

Referring to FIG. 2C, the glazing frame 14 is attached to the retaining frame 12 along their lower edges, where the glazing frame 14 sits on the retaining frame 12. The attachment is used in lieu of the end blocks.

Alternative Embodiments

Figure 1B:
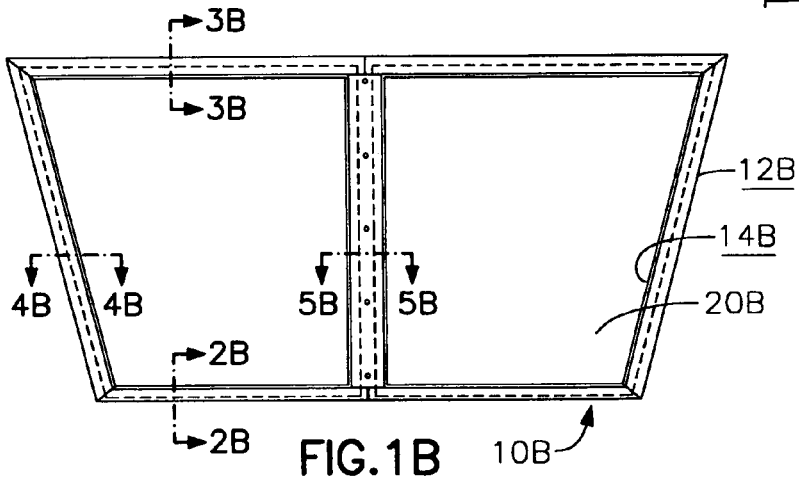
Figure 1C:
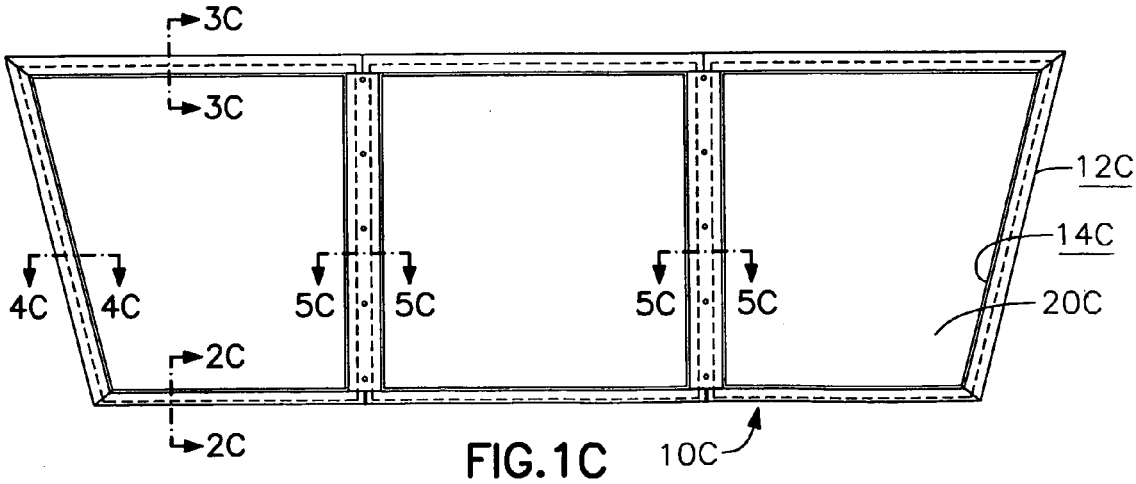

FIG. 1B and FIG. 1C show alternative embodiments to the preferred embodiment, which is shown in FIG. 1A.

FIG. 2B and FIG. 2C show alternative embodiments to the preferred embodiment, which is shown in FIG. 2A.

Figure 3B:
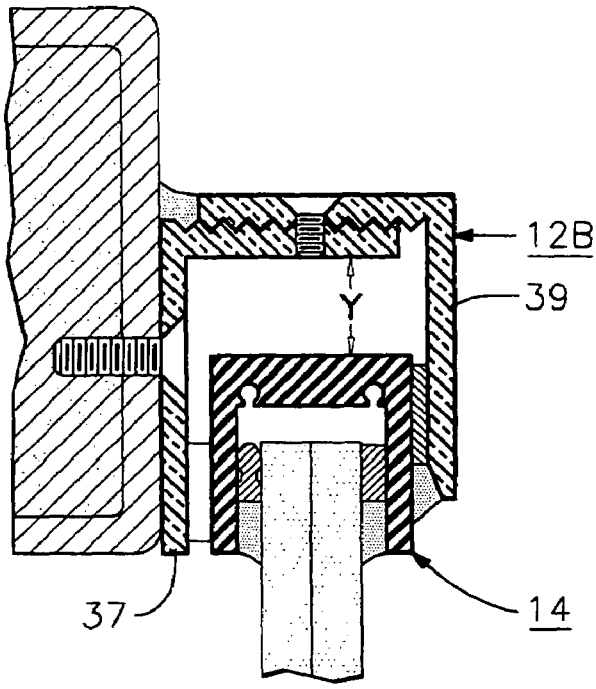
Figure 3C:
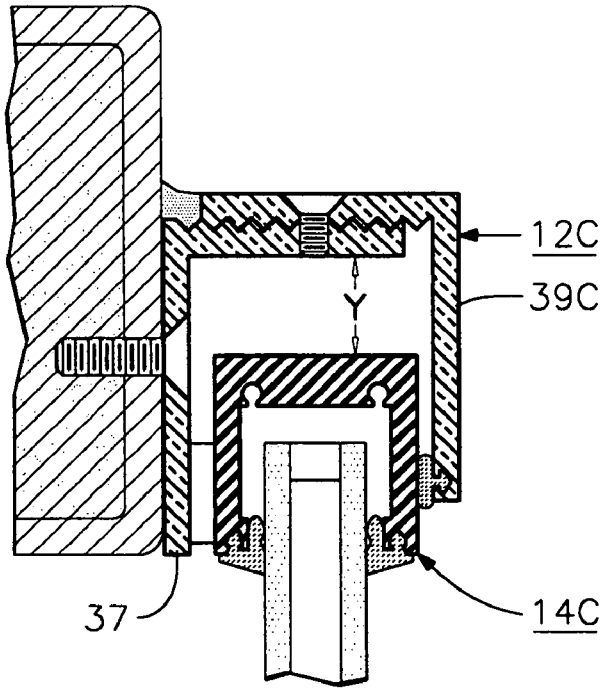

FIG. 3B and FIG. 3C show alternative embodiments to the preferred embodiment, which is shown in FIG. 3A.

Figure 4B:
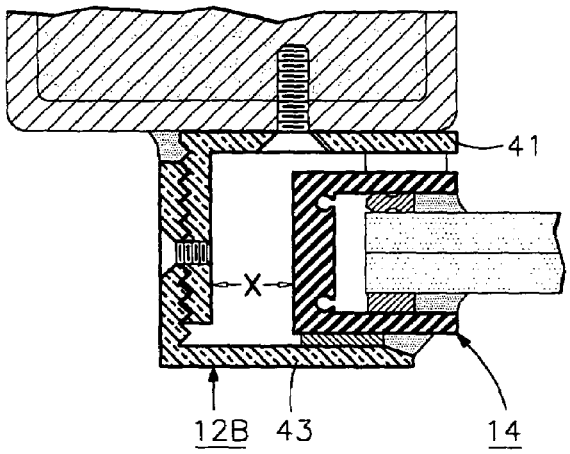
Figure 4C:
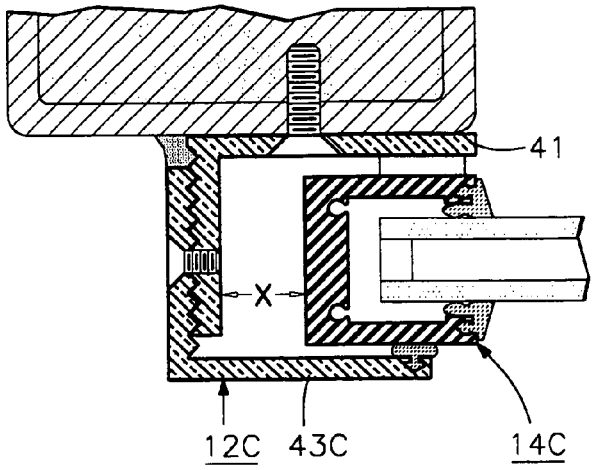

FIG. 4B and FIG. 4C show alternative embodiments to the preferred embodiment, which is shown in FIG. 4A.

Figure 5B:
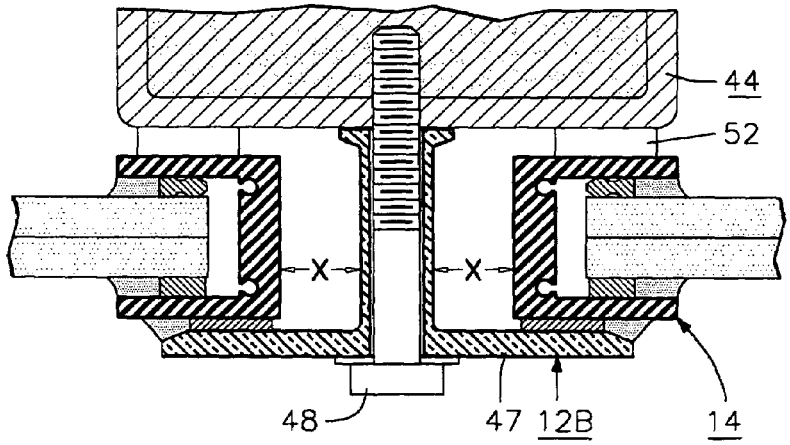
Figure 5C:
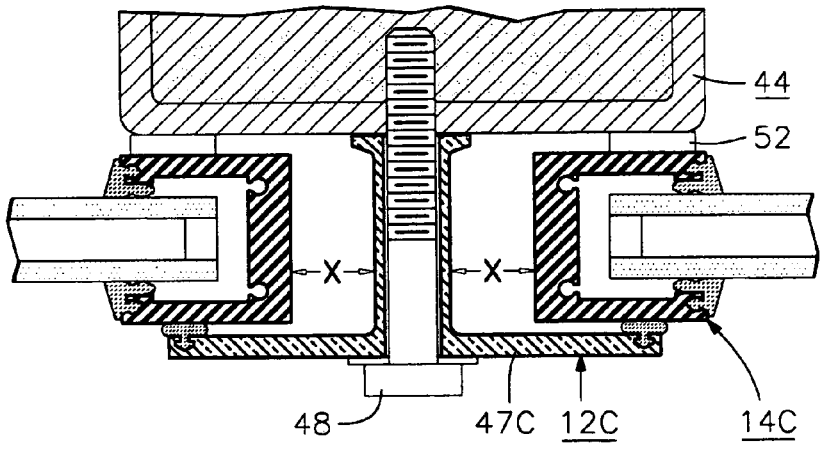

FIG. 5B and FIG. 5C show alternative embodiments to the preferred embodiment, which is shown in FIG. 5A.

I claim:

1. A window assembly, comprising:

a. a glass pane having an inside surface, an outside surface and an outer perimeter edge;

b. a U-shaped inner glazing frame disposed around said perimeter edge of said glass pane, said inner glazing frame including an inside flange, an outside flange and a transverse flange;

c. an outer retaining frame disposed around said inner glazing frame, said outer retaining frame being larger than said inner glazing frame and includes an inside cavity capable of receiving said inner glazing frame, said inside cavity being sufficient in size so that a continuous clearance space is created between said inner glazing frame and said outer retaining frame thereby allowing said inner glazing frame to retain its shape when said outer retaining frame moves laterally with the building main structure during an earthquake or blast, said outer retainer frame including an outside leg, an intermediate leg, and an inside leg;

d. a pair of glazing gaskets, one said gasket being located between said inside flange of said inner glazing frame and said outside surface of said glass pane and a second gasket located between said inside flange of said inner glazing frame and said inside surface of said glass pane;

e. an outside sealant located between the outside flange of said inner glazing frame and said outer leg of said outer retaining frame;

f. an inside spacer disposed between said inner glazing frame and the outside surface of the building, and;

g. means for attaching said outer retaining frame to the outside surface of the building wherein said window assembly includes two opposite lower corners with two end blocks placed in between said outer retainer frame and said inner glazing frame.

2. A window assembly of claim 1, further comprising an attachment means located between said inner glazing frame and said outer retaining frame enabling said inner glazing frame and said outer retaining frame to be connected together at their lower edges only.

3. A window assembly of claim 1, wherein said retaining frame comprises a fixed part which is fixed to the main building structure, and a second part that is selectively attached to said fixed part to facilitate installation and re-glazing, said two parts capable of being adjusted to create different sizes glazing pocket for different glass pane thickness.

4. The window assembly of claim 1, wherein said outer retaining frame is z-shaped in cross-section.

5. The window assembly of claim 4, wherein said means for attaching said outer retaining frame around a windowsill is a plurality of threaded connectors that extend through said inside flange and attach to the outside surface of building.

6. The window assembly of claim 1, wherein said outer retainer frame is U-shaped in cross-section.

7. The window assembly of claim 6, wherein said means for attaching said outer retaining frame to the outside surface of the building is a plurality of threaded connectors that extend through said inside flange and attach to the outside surface of the building.

8. The window assembly of claim 6, wherein said fixed part and said second part include a set of teeth that engage to hold said fixed part and said second part together.

9. The window assembly, of claim 8, further including at least one threaded connector used to securely hold said fixed part and said second part together.

* * * * *